US011002268B2

(12) United States Patent
Goldensoph et al.

(10) Patent No.: US 11,002,268 B2
(45) Date of Patent: May 11, 2021

(54) SEALED CAVITY COMPRESSOR TO REDUCE CONTAMINANT INDUCTION

(71) Applicant: Carleton Life Support Systems Inc., Davenport, IA (US)

(72) Inventors: Gerin Goldensoph, DeWitt, IA (US); Jeff Brown, Davenport, IA (US)

(73) Assignee: Cobham Mission Systems Davenport LSS Inc., Davenport, IA (US)

( * ) Notice: Subject to any disclaimer, the term of this patent is extended or adjusted under 35 U.S.C. 154(b) by 58 days.

(21) Appl. No.: 14/809,885

(22) Filed: Jul. 27, 2015

(65) Prior Publication Data

US 2017/0030346 A1 Feb. 2, 2017

(51) Int. Cl.

| | |
|---|---|
| ***F04B 25/00*** | (2006.01) |
| ***F04B 41/00*** | (2006.01) |
| ***F04B 27/04*** | (2006.01) |
| ***F04B 27/053*** | (2006.01) |
| ***F04B 27/08*** | (2006.01) |
| ***F04B 27/10*** | (2006.01) |
| ***F04B 27/12*** | (2006.01) |
| ***F04B 37/12*** | (2006.01) |
| ***F04B 49/22*** | (2006.01) |
| ***F04B 53/10*** | (2006.01) |

(52) U.S. Cl.

CPC ..... *F04B 49/22* (2013.01); *F04B 25/00* (2013.01); *F04B 27/0409* (2013.01); *F04B 27/0414* (2013.01); *F04B 27/0423* (2013.01); *F04B 27/053* (2013.01); *F04B 27/0878* (2013.01); *F04B 27/0891* (2013.01); *F04B 27/0895* (2013.01); *F04B 27/1045* (2013.01); *F04B 27/12* (2013.01); *F04B 37/12* (2013.01); *F04B 41/00* (2013.01); *F04B 53/10* (2013.01)

(58) Field of Classification Search

USPC ..... 417/266

See application file for complete search history.

(56) References Cited

U.S. PATENT DOCUMENTS 1,229,009 A 6/1917 Allison
1,383,657 A * 7/1921 Noguera ..... F04B 27/0404 417/273

(Continued)

FOREIGN PATENT DOCUMENTS

| | | |
|---|---|---|
| JP | 2001088094 | 4/2004 |
| WO | 2005033506 | 4/2005 |
| WO | 2007019452 | 2/2007 |

OTHER PUBLICATIONS

Air Systems International Inc. Manual No. HP 4009. Nov. 4, 2004. TA3-AXAF Intrinsically Safe Compressor. Air Systems International, Inc, Chesapeake, VA 22320.

*Primary Examiner* — Peter J Bertheaud
*Assistant Examiner* — Geoffrey S Lee
(74) *Attorney, Agent, or Firm* — Woods Oviatt Gilman LLP; Katherine H. McGuire, Esq.

(57) ABSTRACT

A cam driven compressor includes a cam coupled to a plurality of cylinder and piston assemblies. Each cylinder and piston assembly comprises a piston located and movable within a respective cylinder. Each cylinder has a cylinder head. The compressor comprises a housing defining a cavity configured to receive a portion of a source gas from one or more of the cylinders in order to maintain a positive gas pressure within the cavity.

10 Claims, 3 Drawing Sheets

(56) References Cited

U.S. PATENT DOCUMENTS 2,127,591 A * 8/1938 Evans ..... F16J 15/36 277/318
2,198,552 A 4/1940 Rieger
2,252,757 A * 8/1941 Carlson ..... F04B 27/053 417/273
2,279,645 A * 4/1942 Sinclair ..... F04B 1/0443 91/498
2,444,159 A 6/1947 Godfriaux
2,578,139 A * 12/1951 Jones, Jr. ..... F04B 27/053 62/510
2,676,753 A * 4/1954 Britton ..... F04B 27/053 417/203
2,818,816 A * 1/1958 Christenson ..... F04B 53/1075 417/273
2,973,135 A * 2/1961 Greenwald ..... F04D 25/04 415/105
3,344,715 A 10/1967 Wilson
3,490,683 A * 1/1970 Kocher ..... F04B 27/053 417/271
3,622,251 A * 11/1971 Allen ..... F04B 45/04 417/471
3,692,434 A * 9/1972 Schnear ..... F04B 27/053 417/266
3,830,264 A 8/1974 Billet et al.
3,910,164 A * 10/1975 Swadner ..... F04B 27/053 92/128
3,924,968 A * 12/1975 Gaines ..... F04B 27/053 417/53
4,050,852 A * 9/1977 Brucken ..... F04B 27/0414 417/221
4,105,371 A * 8/1978 Savage ..... F04B 27/0409 417/238
4,273,519 A * 6/1981 Gannaway ..... F04B 39/121 417/273
4,313,714 A * 2/1982 Kubeczka ..... F04B 1/053 417/273
4,316,705 A * 2/1982 Siewert ..... F04B 27/053 417/273
4,522,110 A 6/1985 Samuelsson
4,658,798 A 4/1987 Yogo et al.
4,712,518 A 12/1987 Johnson
4,759,692 A * 7/1988 Morse ..... F04B 39/1006 29/888.02
4,874,297 A * 10/1989 Collins ..... F04B 1/0426 417/265
4,948,401 A 8/1990 Izumi et al.
5,033,940 A * 7/1991 Baumann ..... F04B 39/04 417/266
5,078,580 A 1/1992 Miller et al.
5,429,080 A * 7/1995 Pong ..... F01B 1/12 123/195 R
5,740,535 A 4/1998 Rune
6,074,177 A 6/2000 Kobayashi et al.
6,293,764 B1 * 9/2001 Baumann ..... F04B 39/00 417/273
6,328,536 B1 12/2001 Zebuhr
6,422,830 B1 7/2002 Yamada et al.
6,547,534 B1 * 4/2003 Sakamoto ..... F04B 25/00 417/244
7,776,118 B2 8/2010 Min et al.
7,959,415 B2 * 6/2011 Schuetzle ..... F04B 1/0404 417/273
8,011,897 B2 9/2011 Raleigh et al.
8,123,497 B2 * 2/2012 Richey, II ..... A61M 16/10 417/254
8,684,704 B2 * 4/2014 Raleigh ..... F04B 27/0404 417/273
9,624,918 B2 * 4/2017 Goertzen ..... F04B 25/00
9,856,866 B2 * 1/2018 Moore ..... F04B 39/0094
2002/0040715 A1 * 4/2002 Barrett ..... F04B 25/00 128/205.18
2003/0082058 A1 * 5/2003 Sakamoto ..... F04B 25/00 417/244
2003/0156939 A1 * 8/2003 Evans ..... F04B 39/0207 415/26
2005/0120984 A1 6/2005 Kuhn
2005/0201868 A1 * 9/2005 Gao ..... F01B 9/023 417/254
2006/0013698 A1 * 1/2006 Pervaiz ..... F04B 53/10 417/266
2006/0123795 A1 * 6/2006 Fish ..... F01D 25/183 60/772
2006/0230929 A1 * 10/2006 Bliss ..... B01D 53/0407 95/96
2006/0230931 A1 * 10/2006 Bliss ..... B01D 53/0407 95/130
2007/0065301 A1 * 3/2007 Goertzen ..... A61M 16/10 417/273
2007/0140871 A1 6/2007 Bond
2007/0227360 A1 * 10/2007 Atlas ..... A61M 16/10 96/121
2008/0053310 A1 * 3/2008 Bliss ..... A61M 16/10 96/115
2008/0135044 A1 * 6/2008 Freitag ..... A61M 16/16 128/200.26
2008/0219861 A1 * 9/2008 Raleigh ..... F04B 9/042 417/271
2010/0092313 A1 * 4/2010 Suss ..... F04B 27/0414 417/273
2010/0272585 A1 * 10/2010 Raleigh ..... F04B 27/0404 417/273
2010/0319547 A1 * 12/2010 Kondou ..... B01D 53/047 96/143
2013/0209297 A1 * 8/2013 Goertzen ..... F04B 1/00 417/443
2015/0322933 A1 * 11/2015 Hritz ..... F04B 39/0094 417/266

* cited by examiner

SEALED CAVITY COMPRESSOR TO REDUCE CONTAMINANT INDUCTION

BACKGROUND OF THE INVENTION

The present invention relates to compressors and, in a first aspect thereof, more particularly relates to a compressor having a cavity at a positive internal pressure relative to the surrounding environment to reduce induction of contaminants into the product gas produced by the compressor. In another aspect, the invention relates to a compressor having a pressure relief valve in communication with the compressor cavity to maintain the compressor cavity at a desired positive pressure.

Electrically driven compressors must convert rotary motion from a motor into linear motion to actuate a piston or a series of pistons to generate compressed gas. Most gas compressors accomplish this task by means of a crankshaft and connecting rod assembly similar to that found in internal combustion engines. By design, compressors known in the art will create a slight leak around the inter-stage seal located between the piston and cylinder. Some advantages to this design are the proven reliability and the high operating efficiency. One major disadvantage is that these compressors are referenced/vented to atmosphere so as to eliminate a positive pressure cavity. Not only does this waste any leaked gas, but any moisture in the atmosphere may be reintroduced into the product gas via back-diffusion. This back-diffusion of atmosphere decreases the product gas concentration and increases contaminants within the product gas.

By way of example, Aviation Breathing Oxygen (ABO) requires product gas purities exceeding about 99.9%. Thus, current compressors may compromise the product gas purity through cavity leakages. Even at low compression pressures, moisture may be introduced into the product gas thereby leading to a failure in meeting the requirements set forth by MIL-PRF-27210J (Performance Specification—Oxygen, Aviator's Breathing, Liquid and Gas), particularly the requirement that the moisture content of the gas be less than 7 part per million (ppm).

Thus, what is needed is a high pressure compression system that would allow use of high purity gases without impacting gas purity due to compressor leakages.

SUMMARY OF THE INVENTION

The present invention addresses the above needs by providing a cam driven compressor including a cam coupled to a plurality of cylinder and piston assemblies. Each cylinder and piston assembly comprises a piston located and movable within a respective cylinder. Each cylinder has a cylinder head. The compressor comprises a housing defining a cavity configured to receive a portion of a source gas from one or more of the cylinders. A first cylinder may be a low pressure cylinder, wherein a portion of the source gas within the first cylinder is directed into the cavity. The housing may further include a pressure relief valve to prevent over-pressurization of the housing. The pressure relief valve may have a maximum pressure limit of 1 pounds per square inch gauge (psig). The cavity may be filled with the portion of the source gas at a flow rate of about 200 standard cubic centimeters per minute (scc/m) and the housing may be selected to have a positive cavity pressure of about 1 psig.

In a further aspect of the present invention, a method of producing a high purity high pressure gas comprises: a) providing a cam driven compressor, wherein a cam is coupled to a plurality of cylinder and piston assemblies wherein each cylinder and piston assembly comprises a piston located and movable within a respective cylinder, each cylinder having a cylinder head, the compressor comprising a hermetically sealed housing defining a cavity configured to receive a portion of a source gas within the cylinders; b) allowing a source gas to be supplied to the compressor; and c) allowing a portion of the source gas to pressurize the cavity of the housing.

The first cylinder may be a low pressure cylinder and the portion of the source gas may be provided by the first cylinder. The method may further include the step of d) preventing over-pressurization of the housing through a pressure relief valve. The pressure relief valve may have a maximum pressure limit of 1 psig.

BRIEF DESCRIPTION OF THE DRAWINGS

The invention will further be described, by way of example, with reference to the accompanying drawings.

DETAILED DESCRIPTION

Figure 1:
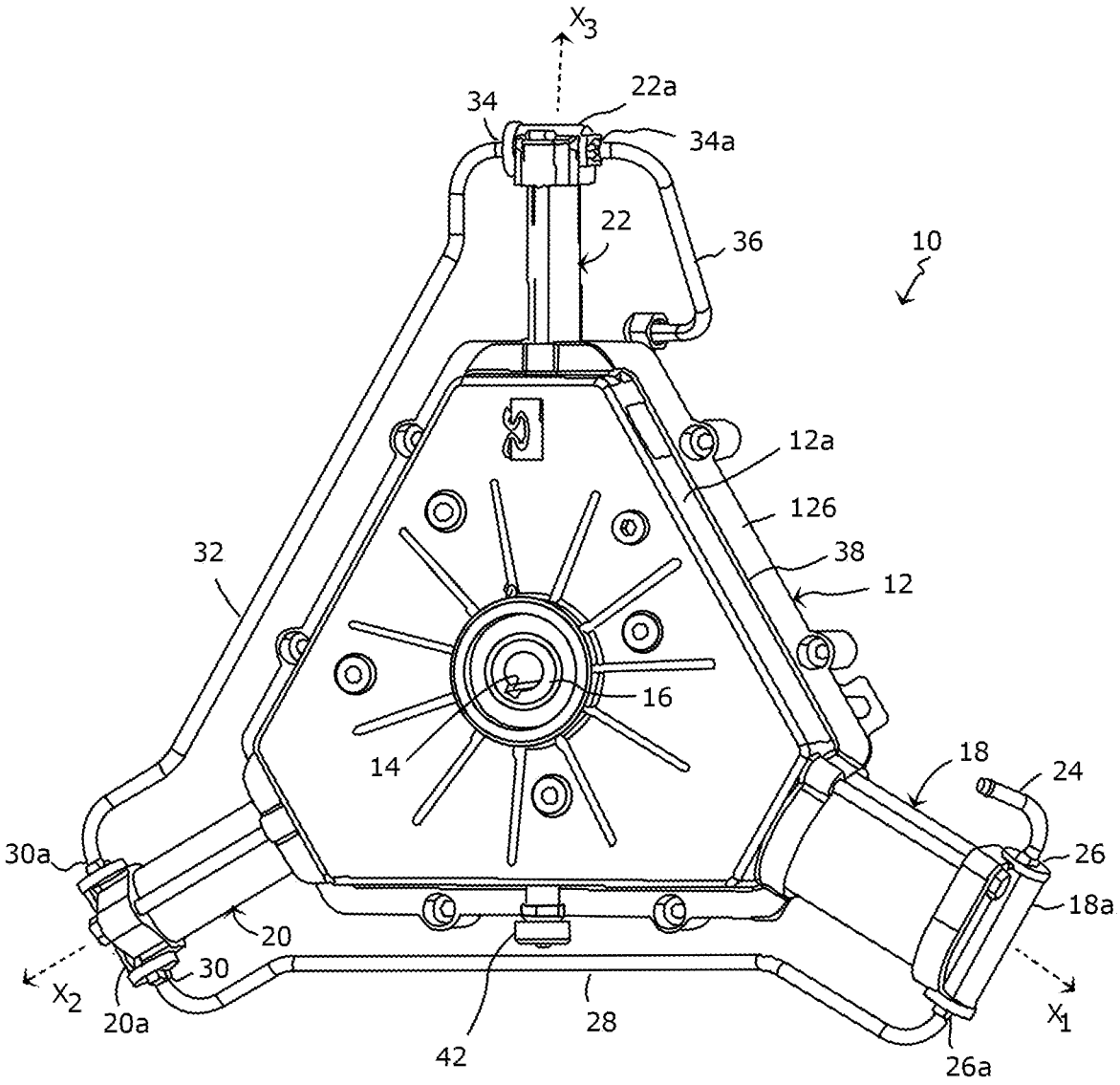
FIG. 1 is a front perspective view of an embodiment of a cam driven compressor in accordance with the present invention.
Figure 2:
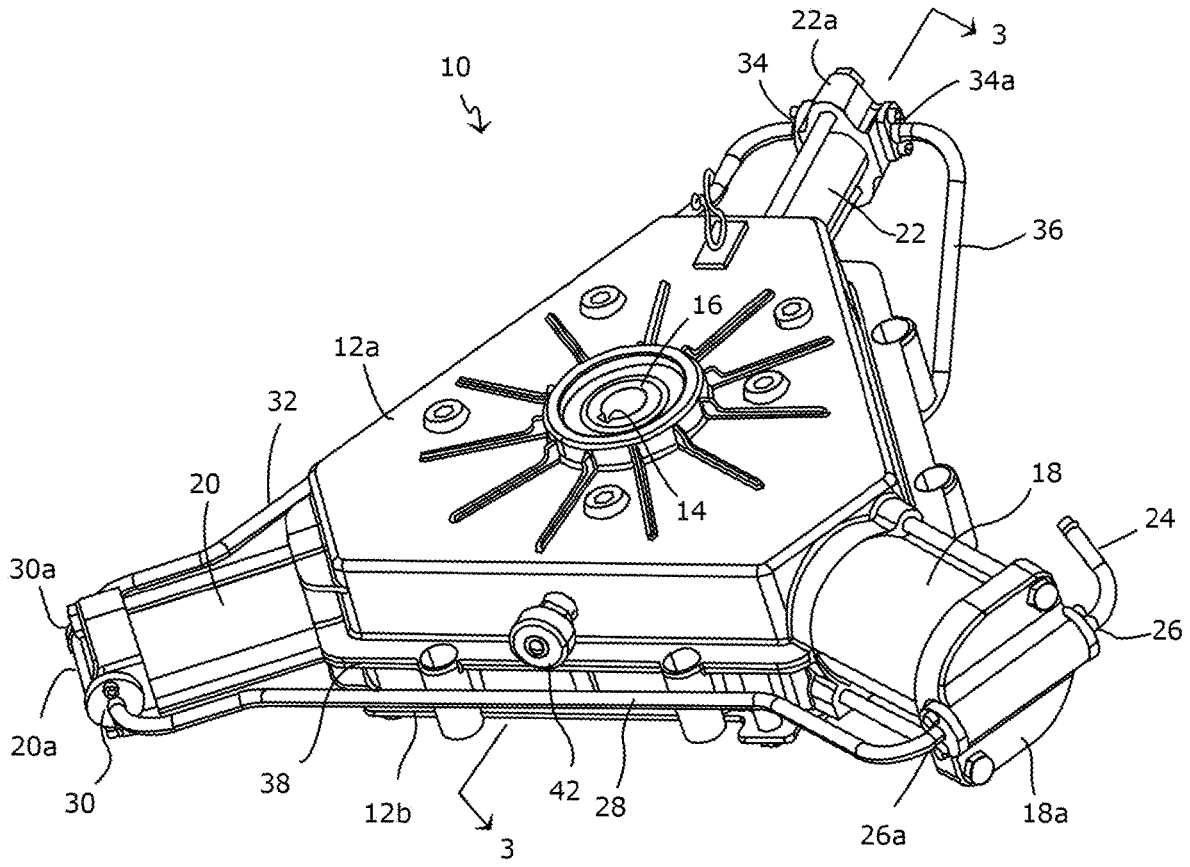
FIG. 2 is a side perspective view of the embodiment shown in FIG. 1.
Figure 3:
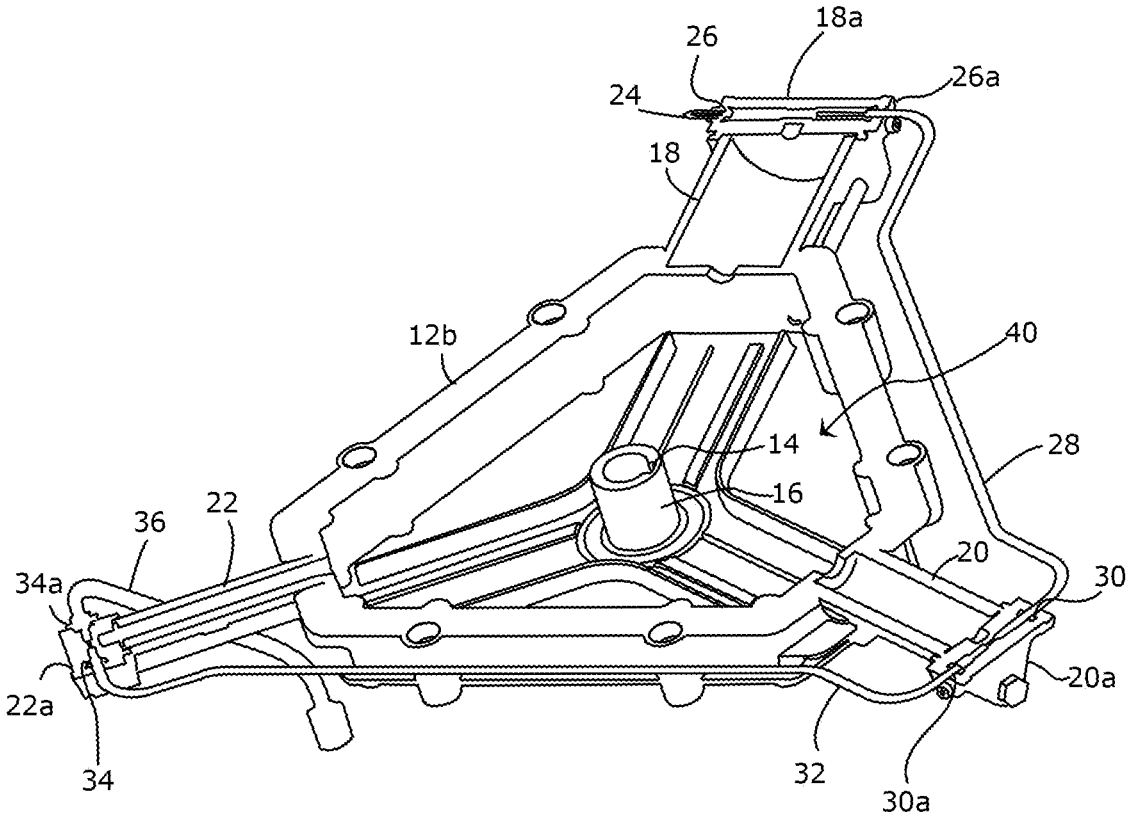
FIG. 3 is a cross section view of the cam driven compressor taken generally along line 3-3 in FIG. 2.

Referring to the drawings, there is seen in FIGS. 1 through 3 one embodiment of the inventive compressor assembly designated generally by the reference numeral 10. Compressor assembly 10 includes a housing 12 and is configured to connect to a motor and speed reducer (not shown) via keyed bore 14 in shaft sleeve 16. Compressor assembly 10 generally includes a housing 12 comprising a block comprised of corresponding block halves 12*a* and 12*b*. First, second and third stage cylinder 18, 20 and 22, respectively, are spaced 120° apart and radially extend along respective axes $X_1$-$X_3$.

For the sake of clarity, the moving components of the compressor have been removed. An example of such suitable components may be found within U.S. Pat. No. 8,684,704 (the '704 patent) assigned to Carleton Like Support Systems, Inc., the entirety of which is incorporated by reference as if fully set forth herein. As recounted within the '704 patent, a compressor may include a cam positioned on shaft sleeve 16 with respective cam follower assemblies operably connected to the cam. Each cam follower assembly may include a respective roller element rotatably connected between respective roller brackets and associated end plates. Each cam follower assembly may further include a respective connecting rod connected to a respective roller element via a respective roller bracket at a first end thereof; and to a respective piston at a second end thereof. Each connecting rod telescopes within a respective linear bearing and each piston is reciprocally located in a respective cylinder 18, 20 and 22. A compressor head 18*a*, 20*a* and 22*a* mounts to the end of a respective cylinder opposite the end from which the respective connecting rod extends.

In this manner, low pressure gas enters via an air tube 24 into first stage cylinder 18 and its included piston assembly via inlet port 26 thereof and enters cylinder 18. When the highest lobe point of the cam reaches the piston assembly, its roller rides along the lobe point of the cam resulting in a piston upstroke (toward head 18*a*) and a first stage compression of the gas within cylinder 18. The compressed gas exits head 18*a* at outlet port 26*a* and is directed through air tube 28 until it reaches head 20*a* wherein the first stage compressed gas enters through inlet port 30 into cylinder 20. At this time, the piston within cylinder 20 begins a downstroke position as the gas enters its respective compression chamber. As the cam continues to rotate, its medium point approaches the cam follower assernhly associated with cylinder 20 which then begins its upstroke. High lobe point next approaches this assembly which completes the second stage compression of the gas within cylinder 20. The compressed gas exits at outlet port 30*a* and is directed through air tube 32 until it reaches head 22*a* wherein the second stage compressed air enters through inlet port 34 into cylinder 22. Again, as the cam continues to rotate, its medium lobe point approaches roller assembly associated with cylinder 22 which begins its upstroke. This roller then rides along the lobe high point of the cam resulting in a full piston upstroke and a third stage compression of the gas within cylinder 22. The compressed then gas exits as high pressure gas (e.g., up to or exceeding 1000 psi), via outlet port 34*a* through air tube 36 which may be connected to an appropriate high pressure gas collection (e.g., air cylinder, not shown). As rotation of the cam continues, this cycle is repeated providing a continuous stream of high pressure gas at outlet port 34*a*.

Returning now to FIGS. 1-3, in accordance with an aspect of the present invention, block halves 12*a* and 12*b* are adapted to be joined so as to produce a sealed compressor body such as through a seal or gasket 38. Similarly, cylinders 18, 20 and 22 may be hermitically sealed to block halves 12*a*, 12*b*. Shaft sleeve 16 may also be sealed to block halves 12*a*, 12*b* as is known in the art. In this manner, housing 12 may be fully sealed such that the cavity 40 defined by the joined block halves 12*a*, 12*b* may be pressurized so as to be slightly above ambient pressure. To pressurize cavity 40, a purge gas may enter volume 40 through leaks around the inter-stage seals between each piston and cylinder.

Housing 12 may further include a pressure relief valve 42 in communication with cavity 40 to prevent over-pressurization of the cavity in the event that a seal fails during any of the compression stages. Pressure relief valve 42 may also help meter the cavity pressure. In accordance with an aspect of the invention, operational efficiencies were optimized to include a pressure relief valve 42 selected to have an upper operating limit of 1 psig with an upper purge flow rate of about 200 scc/m. Thus, cavity pressure may be metered at 1 psig due to the upper operating limit of pressure relief valve 42. In an exemplary sample, oxygen supply gas having less than 1 ppm water at 25 psig was supplied to compressor 10. The resultant high pressure outlet gas was found to contain less than 7 ppm water at 500 psig in about 95% relative humidity environment. In accordance with an aspect of the invention, the first stage cylinder 18 may be configured to receive a pure oxygen supply having greater than 99.9% oxygen, wherein cylinder 18 operates with maximum flows of about 4.0 standard liters per minute (slpm) at maximum 40 psig at ambient temperatures. Third stage cylinder 22 may output greater than 99.9% oxygen gas with maximum flows of about 4.0 slpm at maximum 3,000 psig at ambient temperatures.

While the above example recited a preferred relief valve/cavity pressure and purge flow rate, it should be understood by those skilled in the art that other values may be used depending upon system tolerances and required gas outputs. For instance, increased cavity pressures and/or purge flows may result in less contaminated outlet gases. It should be noted that cavity pressure and purge flow should be controlled, and preferably minimalized, to conserve the high purity gas and improve delivery efficiencies.

Although the invention has been described with reference to preferred embodiments thereof, it is understood that various modifications may be made thereto without departing from the full spirit and scope of the invention as defined by the claims which follow.

What is claimed is:

1. A cam driven compressor, wherein a cam is coupled to a plurality of cylinder and piston assemblies wherein each cylinder and piston assembly comprises a piston located and movable within a cylinder, each cylinder having a cylinder head, the compressor comprising a housing having a first block half attached to a second block half along a longitudinal plane and defining a sealed cavity therebetween, wherein each cylinder and piston assembly is located along said longitudinal plane and extends radially outwardly from the housing in spaced relation with a next successive cylinder and piston assembly of the plurality of cylinder and piston assemblies, wherein each cylinder and piston assembly is in fluid communication with the sealed cavity, and wherein the sealed cavity is configured to receive a portion of a gas exclusively from one or more of the cylinder and piston assemblies to thereby pressurize the sealed cavity of the housing.

2. The cam driven compressor of claim 1, wherein a first cylinder of the plurality of cylinder and piston assemblies is a low pressure cylinder and wherein a portion of the gas within the first cylinder is directed into the sealed cavity.

3. The cam driven compressor of claim 1, wherein the housing includes a pressure relief valve adapted to prevent over-pressurization of the housing.

4. The cam driven compressor of claim 3, wherein the pressure relief valve has a maximum pressure limit of 1 psig.

5. The cam driven compressor of claim 1 wherein the sealed cavity is filled with the portion of the gas at a flow rate of 200 scc/m.

6. The cam driven compressor of claim 1, wherein the housing is selected to have a positive cavity pressure of 1 psig.

7. A method of producing a high purity high pressure gas, comprising:

a) providing a cam driven compressor, wherein a cam is coupled to a plurality of cylinder and piston assemblies wherein each cylinder and piston assembly comprises a piston located and movable within a cylinder, each cylinder having a cylinder head, the compressor comprising a housing having a first block half attached to a second block half along a longitudinal plane and defining a sealed cavity therebetween, wherein each cylinder and piston assembly is located along said longitudinal plane and extends radially outwardly from the housing in spaced relation with a next successive cylinder and piston assembly of the plurality of cylinder and piston assemblies, wherein each cylinder and piston assembly is in fluid communication with the sealed cavity, and wherein the sealed cavity is configured to exclusively receive a portion of a gas from one or more of the cylinder and piston assemblies to thereby pressurize the sealed cavity of the housing;

b) allowing the source gas to be supplied to the compressor; and c) allowing a portion of the source gas to pressurize the sealed cavity of the housing.

8. The method in accordance with claim 7, wherein a first cylinder of the plurality of cylinder and piston assemblies is a low pressure cylinder and wherein the portion of the source gas is provided by the first cylinder.

9. The method in accordance with claim 7, wherein the housing includes a pressure relief valve adapted to prevent over-pressurization of the housing.

10. The method in accordance with claim 9, wherein the pressure relief valve has a maximum pressure limit of 1 psig.

* * * * *